US006276315B1

(12) United States Patent
Chiyouji et al.

(10) Patent No.: US 6,276,315 B1
(45) Date of Patent: Aug. 21, 2001

(54) VALVE OPENING AND CLOSING MECHANISM IN ENGINES

(75) Inventors: Masami Chiyouji; Yoshiaki Higashi; Norihisa Ikemura, all of Suzuka (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/369,929

(22) Filed: Aug. 9, 1999

(30) Foreign Application Priority Data

Aug. 10, 1998 (JP) ..... 10-225686

(51) Int. Cl.[7] ..... F01L 1/00
(52) U.S. Cl. ..... 123/90.1; 123/90.16; 123/90.17
(58) Field of Search ..... 123/90.1, 90.15, 123/90.16, 90.17, 90.23, 90.31, 90.41, 90.44, 90.46, 90.48, 90.54

(56) References Cited

U.S. PATENT DOCUMENTS 4,539,953 * 9/1985 Sasaki et al. ..... 123/90.41
4,598,674 * 7/1986 Nono et al. ..... 123/90.41
4,617,880 * 10/1986 Yoshizaki ..... 123/90.16
4,676,203 * 6/1987 Nouno ..... 123/90.44
4,706,620 * 11/1987 Gill ..... 123/90.54
4,903,651 * 2/1990 Matsuura et al. ..... 123/90.46
4,911,112 * 3/1990 Oikawa et al. ..... 123/90.16
5,060,605 * 10/1991 Yamazaki ..... 123/90.23
5,148,783 * 9/1992 Shinkai et al. ..... 123/90.16
5,327,860 * 7/1994 Kruger ..... 123/90.48

OTHER PUBLICATIONS

Patent Abstract of Japan, Pub. No. 10218353, Pub. Date Aug. 18, 1998.
Patent Abstract of Japan, Pub. No. 06310393, Pub. Date Nov. 4, 1994.

* cited by examiner

*Primary Examiner*—Philip H. Leung
*Assistant Examiner*—Fadi H. Dahbour
(74) *Attorney, Agent, or Firm*—Liniak, Berenato, Longacre & White

(57) ABSTRACT

When a valve 10 is opened, a locking ball 8 moves upward with respect to a rocker arm 3 and the locking ball is located between the rocker arm 3 and a push rod 5. The push rod 5 moves downward integral with the rocker arm 3 in a condition the push rod 5 is locked. When a valve 10 is closed, the locking ball 8 moves downward with respect to the rocker arm 3 and the push rod 5 is placed in unlocked condition. A retaining member 3A in the rocker arm 3 contacts the circlip 9 and the push rod 5 moves upward. By this construction, it becomes possible to eliminate adjustment work of tappet clearances and also unfavorable conditions caused by adjustment work of tappet clearances.

4 Claims, 11 Drawing Sheets

3
3A
5
9
8
7
6
10
11
11A
12
ΔL1
ΔL2

5
3A
8
10
4A
3
α2
8
Δl2
Δl
Δl1
2
8'
4A'
5'
2A
α1
8'
20

VALVE OPENING AND CLOSING MECHANISM IN ENGINES

BACKGROUND OF THE INVENTION

1. Field of the Invention

The present invention relates to a valve opening and closing mechanism in engines. In particular, the present invention relates to the valve opening and closing mechanism in engines which does not require any adjustment work of tappet clearances.

2. Prior Art

In automotive engines, as shown in FIG. 1, there are provided with rocker arms 2 and 3 which are actuated by means of cams 1. The rocker arms 2 and 3 are provided with through holes at each one end and through which push rods 5, 5 are inserted, respectively. The rocker arms 2 and 3 rock consecutively as the cams 1 rotate.

For instance, when the push rod 5 in gas exhaust side advances, a valve stem 11 moves downward against the force of a valve spring 12 to open a valve 10. Whereas, when the push rod 5 returns backward, the valve stem 11 moves upward by means of the force of the valve spring 12 to close the valve 10. This construction of the valve mechanism is substantially same in gas intake side consisting of a valve 20, a valve stem 21 and a valve spring 22.

In practical operation of engines, the valve 10 of this valve opening and closing mechanism is expanded due to the heat generated in actual operation of engines. As shown in FIG. 2A, when the valve 10 is heat expanded, the lower end of said valve 10 moves downward by contacting the head of the valve stem 11 with the lower end portion of the push rod 5 in the rocker arm 3 and, as shown in FIG. 2B, a clearance B is generated between the valve 10 and a combustion chamber 30. The gas in the combustion chamber 30 is thus leaked to disturb satisfactory operation of engines.

In order to avoid such unfavorable condition, a tappet clearance TC is formed between the valve 10 and the push rod 5 in conventional engines. This is shown in FIG. 1B. When the valve 10 is heat expanded in actual operation of engines and a displacement due to such heat expansion is generated, it is absorbed by means of the tappet clearance TC.

Practically, when engines are assembled, an adjustment screw 41 is rotated by means of a screwdriver 42 so that a predetermined clearance of TC between the valve 10 and the push rod 5 may be attained. This adjustment work of the tappet clearance TC is achieved by a workman. Various thickness gauges and some differential.pressure gauges are applied for the adjustment work (not shown in FIG. 1B).

However, there have been observed some defects in the adjustment work of the conventional tappet clearance TC. It always needs an extra workman to adjust the tappet clearance. There also have been observed some adjustment errors or unintentional disregarding of adjustment work. As thickness gauges are used by workman, an accurate adjustment cannot be expected. The adjustment work also requires long time.

Further, due to an existence of the tappet clearance TC, the push rod 5 hits the valve stem 11 when said valve 10 is pressed to be opened. In this occasion, the tappet noises are generated. This is also a problem inevitable.

Apart from the aforementioned tappet clearance adjustment work there has been a system called an oil tappet. This system applies a hydraulic pressure to automatically adjust tappet clearances. However, such oil tappet system requires some liquid passages. Arrangement of the liquid passages is rather complex. It is, therefore, difficult to apply said system to applicant's HONDA V-TEC engine.

The object of the present invention is to offer a valve opening and closing mechanism which is easy to be applied to somewhat complex engines like the HONDA V-TEC engine. The valve opening and closing mechanism according to the present invention does not require any adjustment work of tappet clearances. A clearance between the push rod and the valve is eliminated. Unfavorable effects due to the adjustment work by workman are eliminated.

SUMMARY OF THE INVENTION

In a valve opening and closing mechanism in engines consisting of cams, rocker arms, push rods, valves, valve springs, the present invention provides a circlip on the top portion of the push rod of the rocker arm, a head of said push rod and an end of a valve stem are contacted, a heat expansion displacement absorbing mechanism is provided, the heat expansion displacement absorbing mechanism being provided in a through hole of the rocker arm at its one end, a tapered portion having a smaller diameter as it goes away from the valve and a push rod control means which is movable along the longitudinal direction of said push rod are located between such tapered portion and the push rod.

There are provided with return springs to absorb displacement of the valve due to heat expansion to push the head of the push rod toward the valve by means of a force weaker than that of the valve springs. In this occasion said push rod control means actuate as a receiver of the force. When the valve is opened, said push rod control means moves away from the valve with respect to the rocker arms and is placed between said rocker arm and said push rod, said push rod advances integral with said rocker arm. When the valve is closed, said push rod control means approaches said valve with respect to the rocker arm and said push rod comes in uncontrolled condition. Said rocker arm contacts the circlip and then the push rod returns backward.

PREFERRED EMBODIMENT OF THE PRESENT INVENTION

Now the present invention is explained with reference to the accompanied drawings.

Figure 1A:
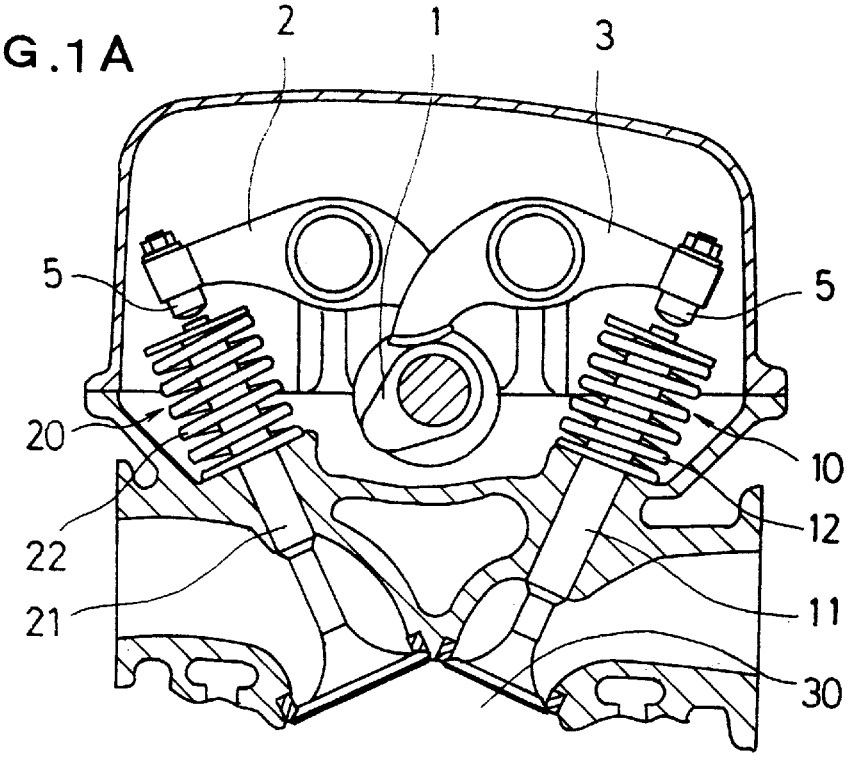
PRIOR ART FIG.1A
FIG. 1A is a cross-section of the conventional valve opening and closing mechanism.
Figure 1B:
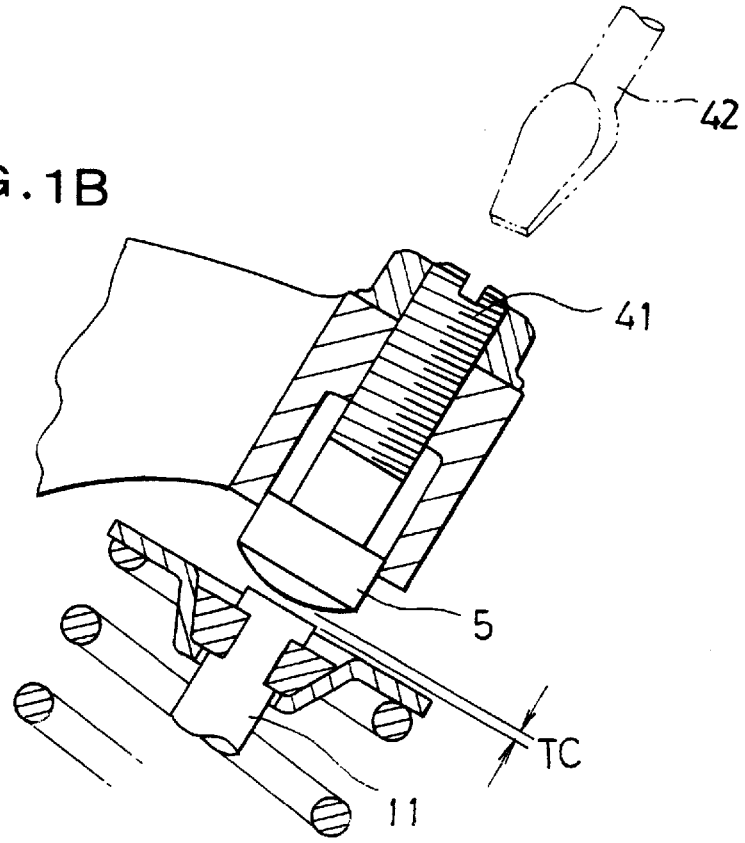
FIG. 1B is an explanation to show adjustment work of the tappet clearance.
Figure 2A:
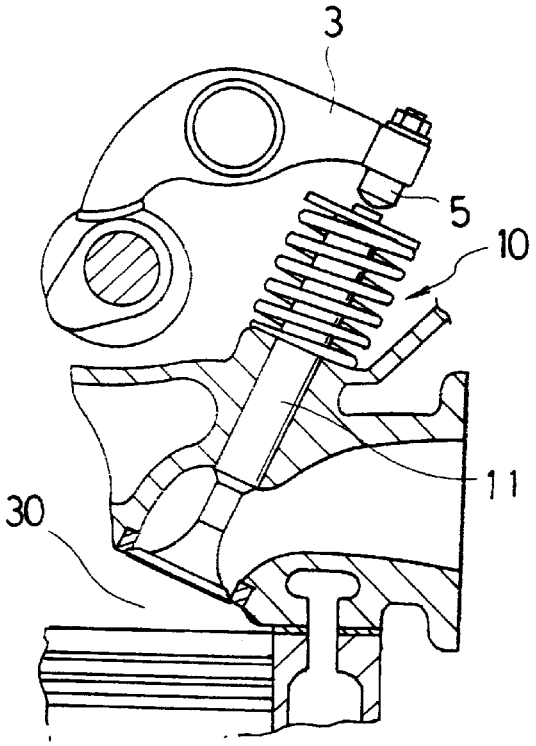
PRIOR ART FIG. 2A
FIG. 2A and FIG. 2B show a status in which a clearance is generated between the valve and a combustion chamber due to heat expansion of the valves.
Figure 2B:
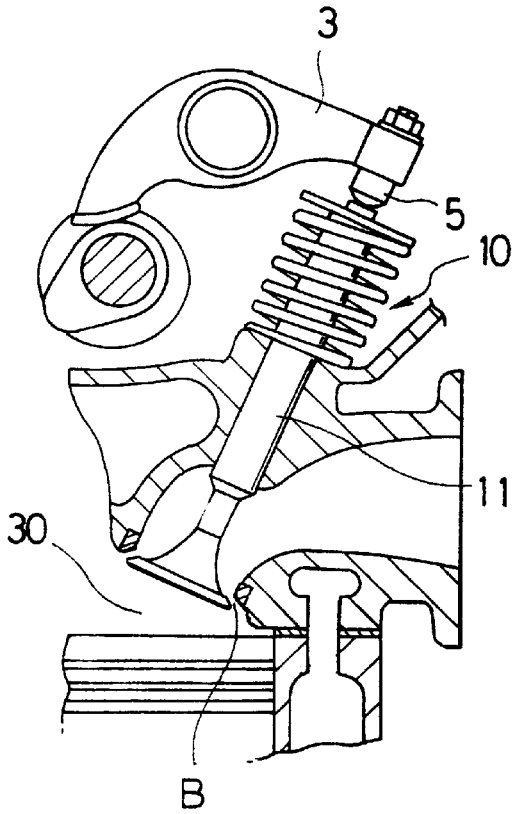
Figure 3:
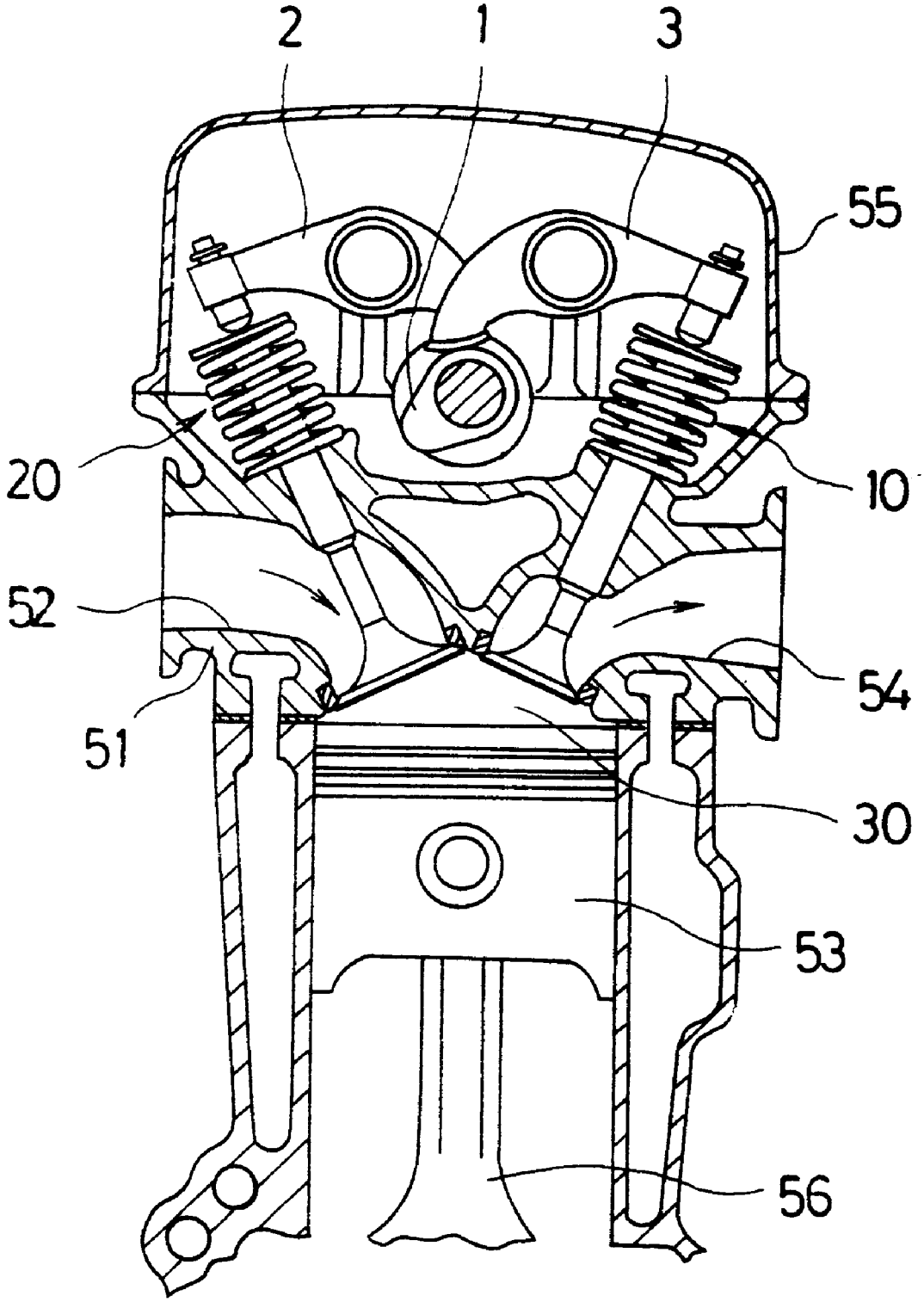
FIG. 3 is a cross-section which shows a valve opening and closing mechanism according to the present invention.

As shown in FIG. 3, the valve opening and closing mechanism according to the present invention is provided with the rocker arm 2 in gas intake side and another rocker arm 3 is provided in gas exhaust side, both of which actuate with respect to the motion of the cams 1. By the rocking motion of the rocker arm 3 in gas exhaust side of the engine the valve 10 is opened and closed. On the other hand, by the rocking motion of the rocker arm 2 in gas intake side of the engine, the valve 20 is opened and closed. As shown by arrow the gas is charged to a combustion chamber 30 which is formed between the valves 10 and 20 and a piston 53 through a gas intake opening 52 which is formed in a cylinder head 51. By opening the valve 10 in exhaust side the gas is exhausted outside from the combustion chamber through an exhaust opening 54. Reference numeral 55 indicates a cover and reference numeral 56 indicates a piston rod.

Figure 4:
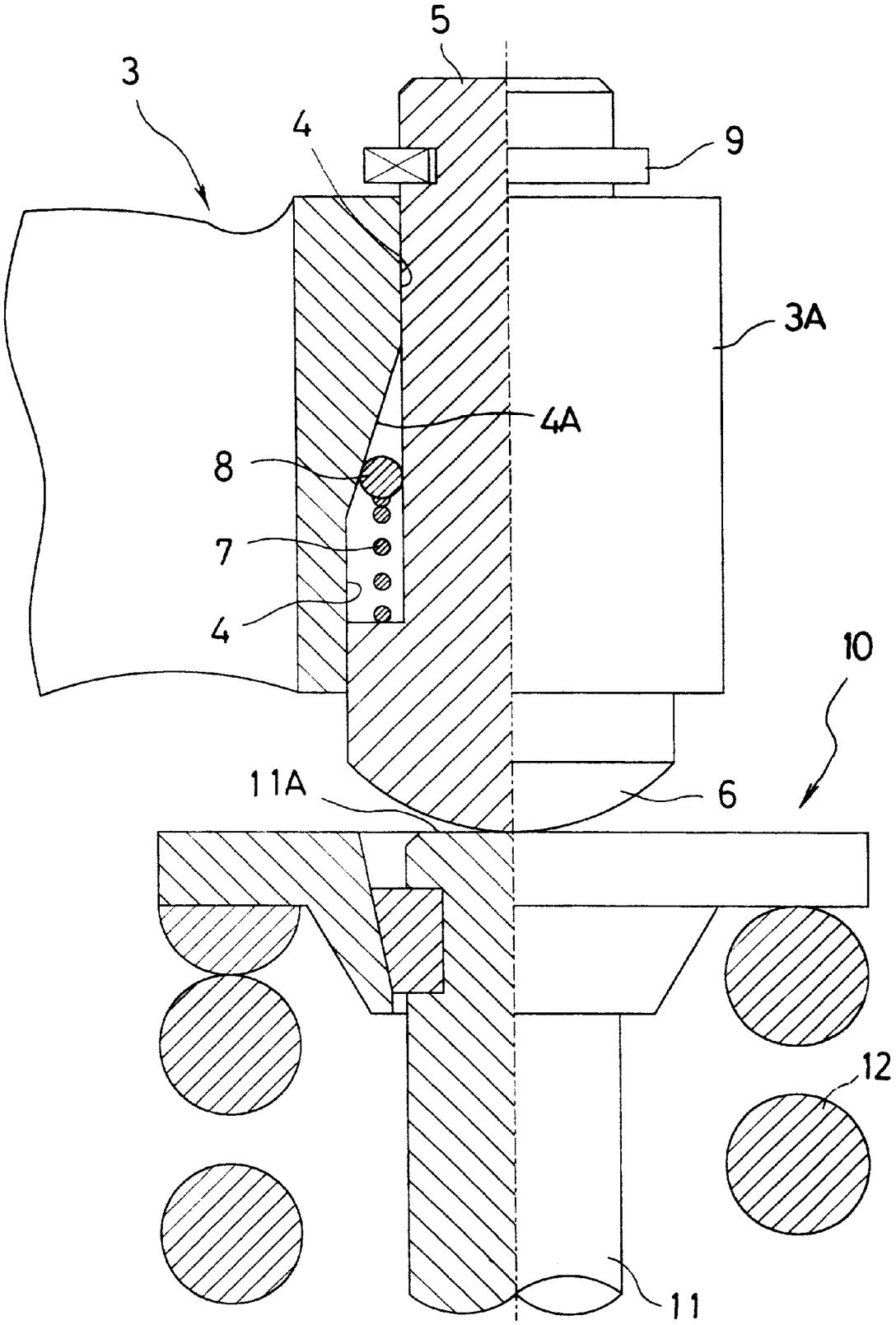
FIG. 4 is a partial and essential cross-sectional side-elevation of the valve opening and closing mechanism according to the present invention.
Figure 5:
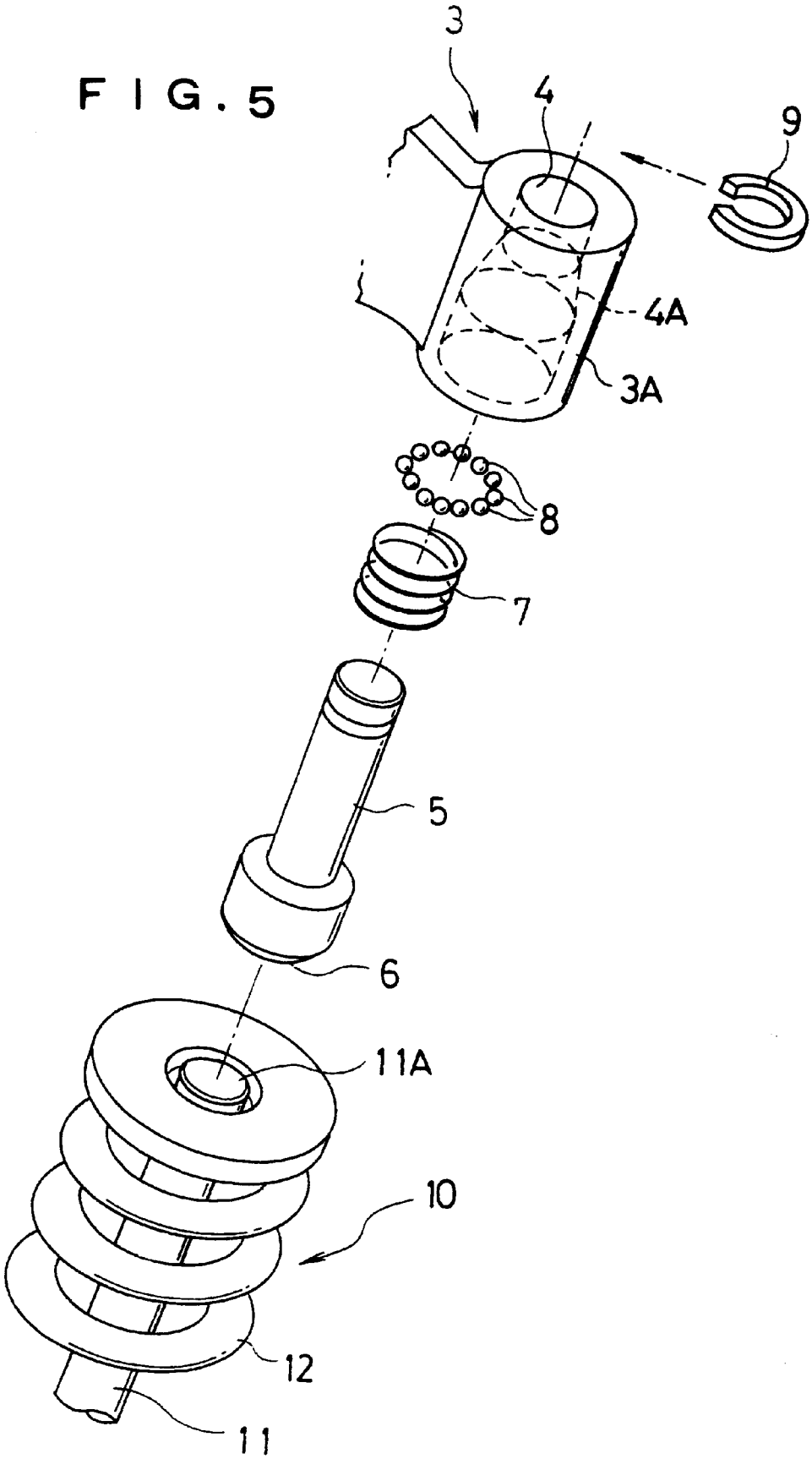
FIG. 5 is an analytical and perspective view of the valve opening and closing mechanism according to the present invention.

Now the structure of the valve opening and closing mechanism is explained in gas exhaust side. As shown in FIG. 4 and FIG. 5, a through hole 4 is formed in a retaining member 3A provided at one end of the rocker arm 3. A push rod 5 is inserted in the through hole 4.

At the lower end of the push rod 5 there is provided a head 6 which always contacts a stem end 11A of a valve stem 11 of the valve 10. Substantially in the central part of the through hole 4 there is formed a tapered portion 4A which becomes smaller diameter as it extends upward. There are provided a return spring 7 and the locking balls 8, 8 between the tapered portion 4A and the head 6. The return spring 7 consists of extendable springs. The locking balls 8, 8 act as a receiving portion of said return spring 7. The return spring 7 imparts a force to the locking balls 8, 8 in upward direction, whereas, the locking balls 8, 8 are movable along the longitudinal direction of the push rod 5. The locking balls of the present invention comprise a push rod control means.

Furthermore, a circlip 9 is provided at the top end of the push rod 5. The circlip 9 contacts the upper surface of the retaining member 3A to prevent the push rod from moving downward relatively.

These push rod 5, return spring 7, locking balls 8, 8 etc. are also provided in the gas intake side. The structure is almost the same as that in the gas exhaust side. Thus, explanation is omitted.

Next, the heat expansion absorbing work of the valve 10 in the valve opening and closing mechanism according to the present invention is explained.

The valve opening and closing mechanism according to the present invention is shown in FIG. 4 and FIG. 5. The head 6 of the push rod 5 always contacts the stem end 11A of the valve stem 11. There is not provided with a clearance to absorb a displacement due to heat expansion of the valve 10. The return spring 7 functions as a heat expansion displacement absorber in this case.

Figures 6A, 6B:
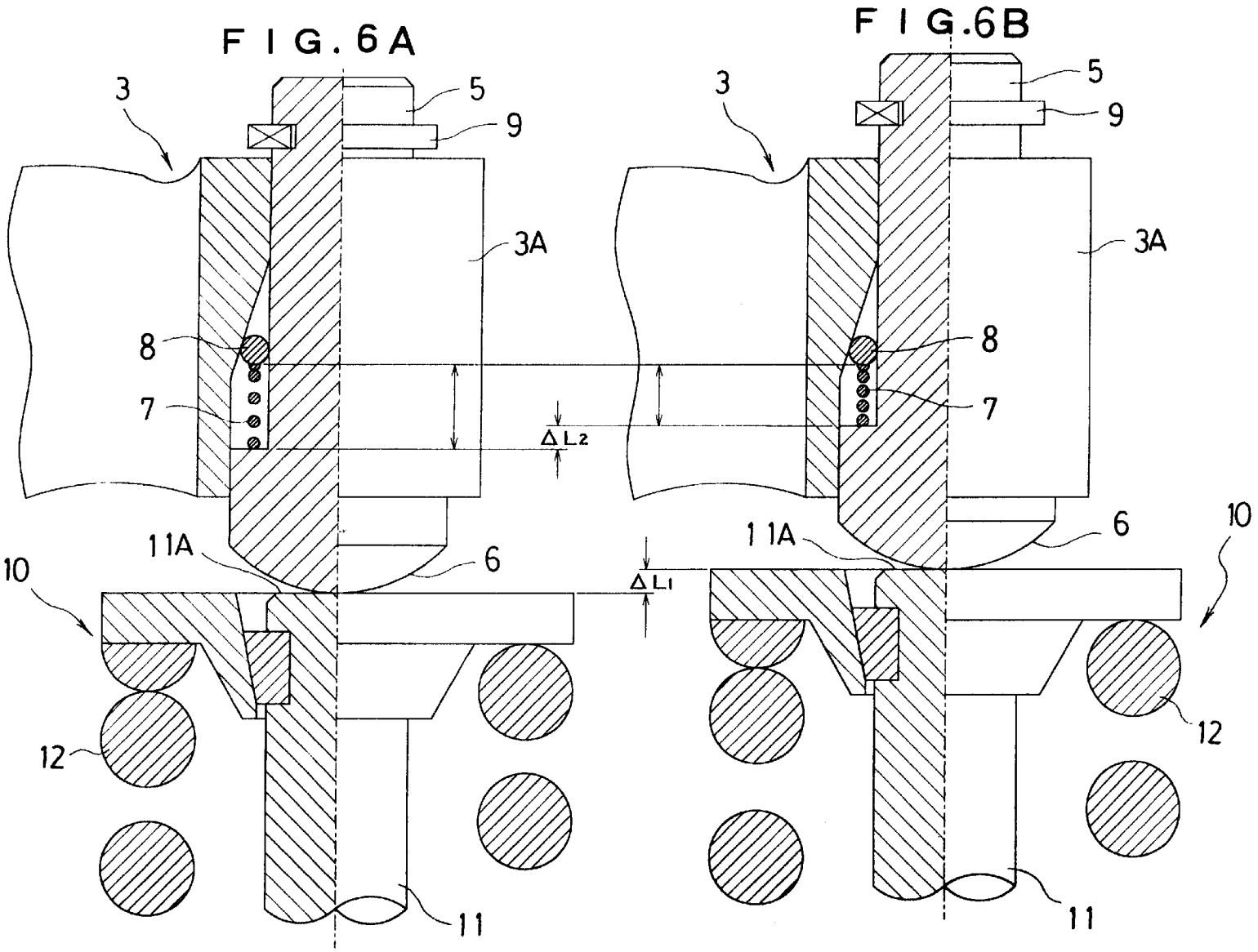
FIG. 6A and FIG. 6B are showing the displacement absorbing mechanism in the valve opening and closing mechanism according to the present invention.

As shown in FIG. 6A in ordinary case in which the heat expansion is not generated in the valve 10, the return spring 7 pushes the head 6 to the direction of the valve stem 11 as a receiving member of the locking ball 8. For this reason, no clearance is caused between the head 6 and the stem head 11A of the valve stem 11.

When the valve 10 is heat expanded, as shown in FIG. 6B, the valve stem 11 is expanded and a stem head 11A is increased by $\Delta L1$. At this time the return spring 7 pushes the head 6 toward the valve stem 11 with a weaker pushing force than that of the valve spring .12. For this reason, when a length of raised lift of the stem head 11A due to a heat expansion of the valve stem 11 is indicated as $\Delta L1$ and a length of reduced lift of the return spring 7 by absorbing a heat expansion of the valve stem 11 is indicated as $\Delta L2$, $\Delta L1$ is equal to $\Delta L2$, $\Delta L1=\Delta L2$. Like that, the amounts of heat expansion of the valve 10 is perfectly absorbed by the return spring 7. Thus a clearance indicated as B between the valve stem 11 and the combustion chamber 30 is not generated.

Accordingly, adjustment work of tappet clearance becomes unnecessary and assembling time of the engine is reduced. The tappet noises are not generated. Unlike the oil tappet system, it is unnecessary to provide any liquid passages. Thus, it is easily applied to the complex engines like HONDA V-TEC engine.

The valve opening and closing operation according to the present invention is explained with reference to the accompanied drawing FIG. 7.

Figure 7A:
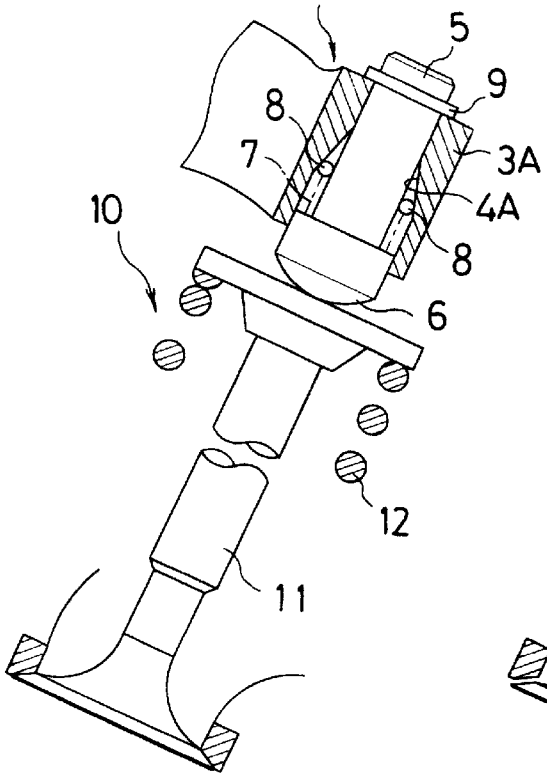
FIG. 7A, FIG. 7B, FIG. 7C and FIG. 7D show a consecutive work of valve opening and closing mechanism according to the present invention.
Figure 7B:
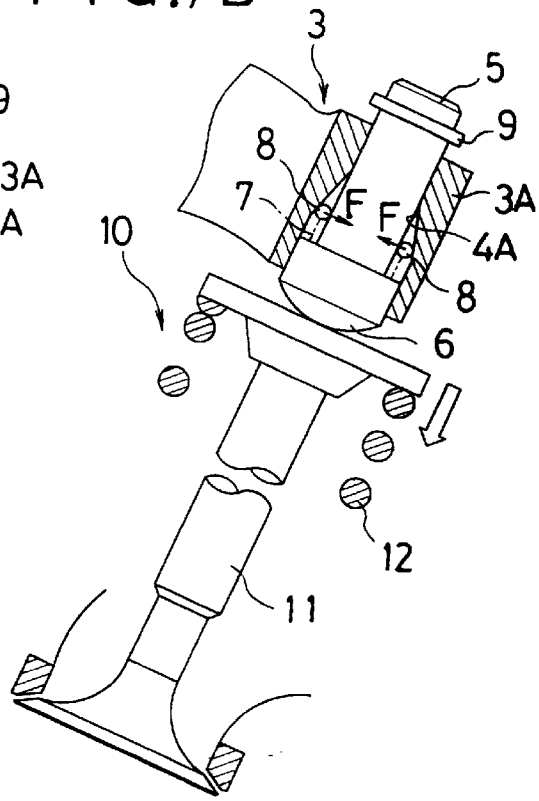

As shown in FIG. 7A, when the valve 10 is closed the circlip 9 is in condition of contact with the surface of the retaining member 3A of the rocker arm 3. When the rocker arm 3 starts going down in a rapid speed the opening operation of the valve 10 is started. By acceleration caused by the motion of the rocker arm 3 the push rod 5 and the locking balls 8, 8 are raised upward with respect to the rocker arm 3. As said push rod 5 and said locking balls 8, 8 are going up, the locking balls 8, 8 are placed, as shown in FIG. 7B, between the tapered portion 4A and the push rod 5 and the force indicated with reference characters F, F directions are generated. The push rod 5 is in condition controlled by the rocker arm 3. When the push rod 5 is locked by the rocker arm 3, the push rod 5 goes downward integral with the rocker arm 3 to press down the valve stem 11 and to open the valve 10 gradually.

Figure 7C:
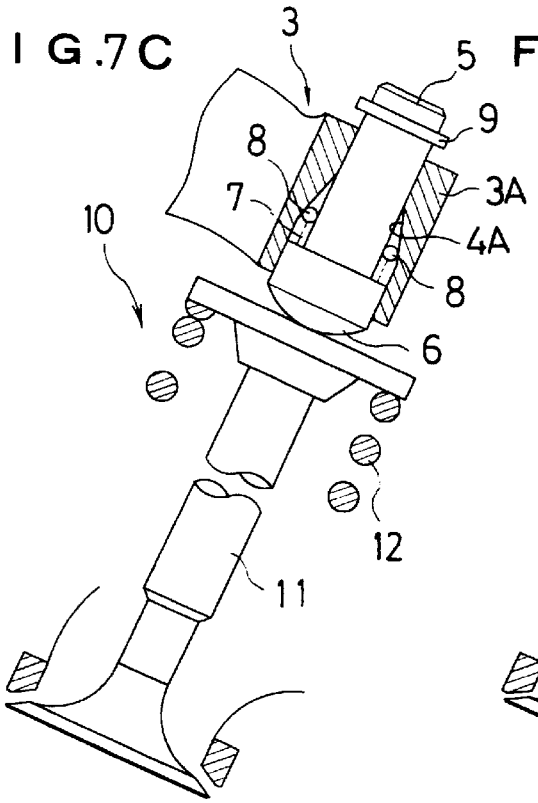
Figure 7D:
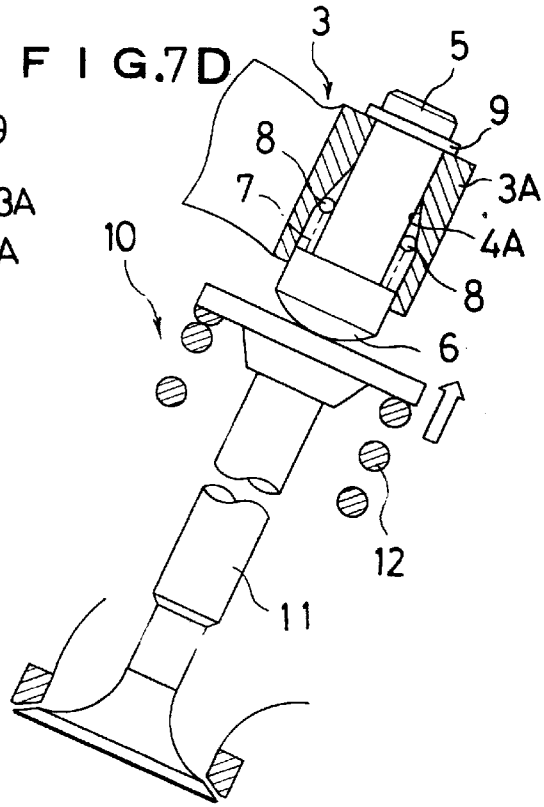

As shown in FIG. 7C, the rocker arm 3 is once stopped when it is reached the utmost lower point and then it adversely goes up in a rapid speed. By the acceleration generated at this time, the push rod 5 and the locking balls 8, 8 move downward with respect to the rocker arm 3. The push rod 5 is released from the control by the locking balls 8, 8. After that the surface of the retaining member 3A in the rocker arm 3, as shown in FIG. 7D, contacts the circlip 9 provided on the push rod 5. The push rod 5 is raised (returns backward) and then the valve stem 11 moves upward by the force of the valve spring 12 and the valve 10 is closed.

When the rocker arm 3 is reached to the utmost upper point, the rocker arm 3 returns to the status shown in FIG. 7A and it once stops. Then the rocker arm 3 resumes its motion adversely downward. After that it repeats reciprocation motion and the valve 10 is opened and closed.

The second embodiment of the present invention is explained.

Figure 8:
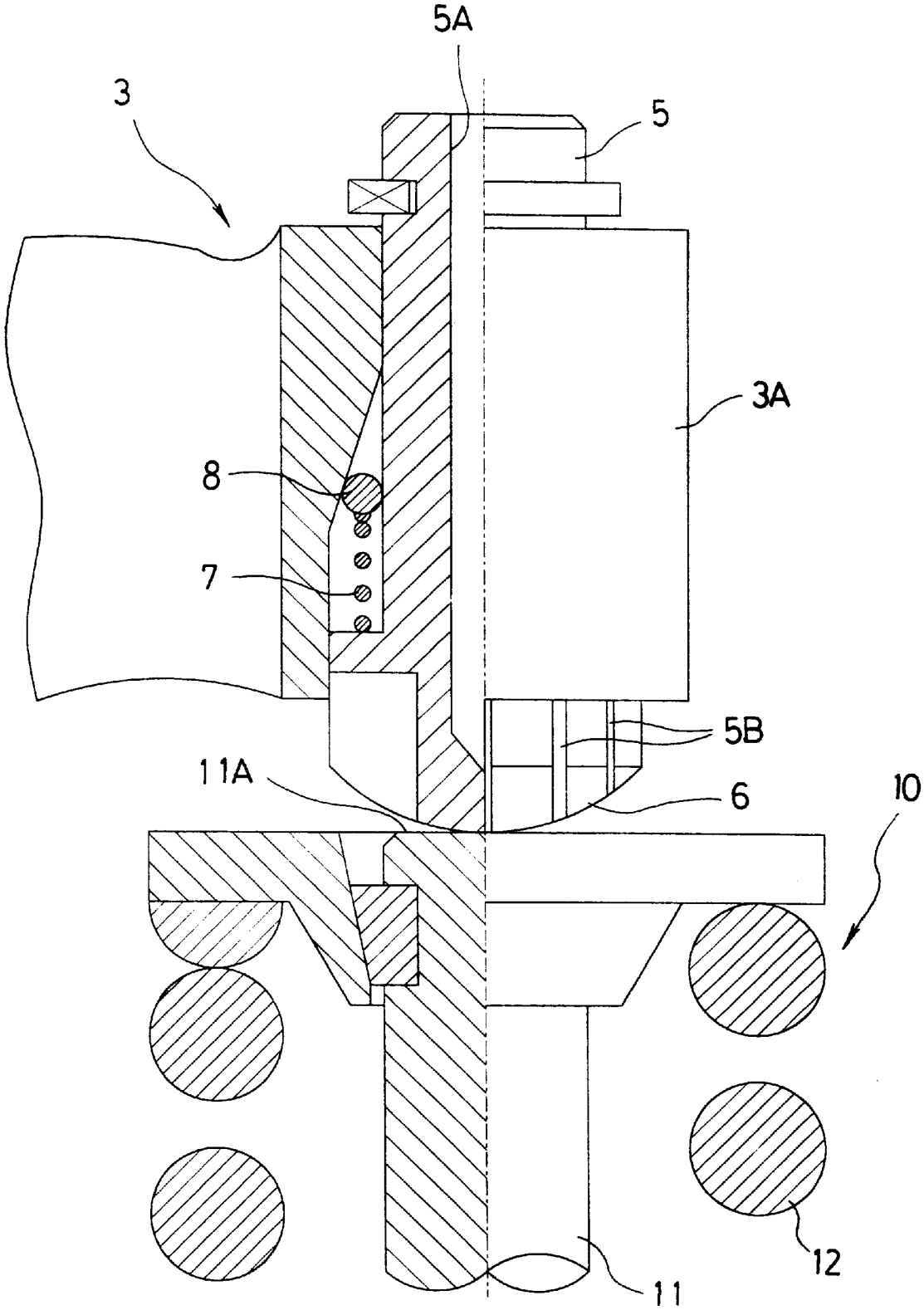
FIG. 8 is a partial and cross-sectional side-elevation which shows status of the second embodiment according to the present invention.

As shown in FIG. 8, a heat exhaust through hole 5A is formed along the longitudinal direction in the push rod 5. The heat exhaust through hole 5A is filled with a cooling liquid. On the surface of the push rod 5 there are engraved exhaust rib cuts 5B, 5B.

As the push rod 5 is always in contact with the stem head 11A of the valve stem 11, an excessive heat is easy to be transferred from the combustion chamber 30 (refer to FIG. 3). The heat exhaust through hole 5A is formed in the push rod 5. Said heat exhaust through hole 5A is filled with a cooling liquid and it is also provided with a cooling rib cut 5B. Thus, the push rod 5 is effectively cooled.

The. push rod 5 is provided with the heat exhaust hole 5A and a cooling liquid is filled with said push rod 5. It is of course possible to form either the heat exhaust hole 5A or the rib cut 5B. It is also possible not to fill the rib cut with cooling oil. It is also possible to fill the heat hole 5A with cooling water in place of the cooling liquids.

The third embodiment of the present invention is explained.

Figures 9A, 9B:
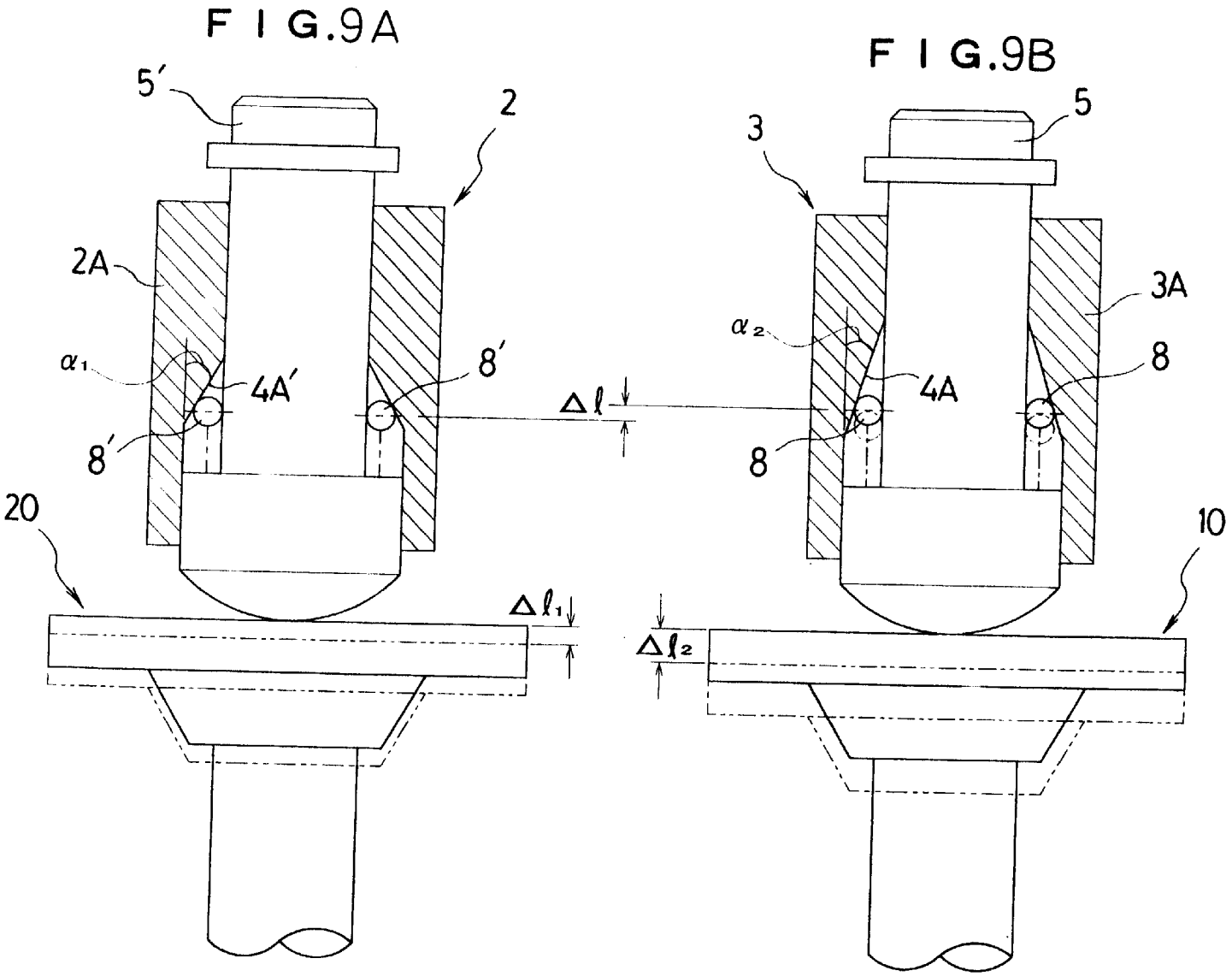
FIG. 9A and FIG. 9B show a status of the third embodiment according to the present invention.

The valve opening and closing mechanism in gas intake side in FIG. 9A and another valve opening and closing mechanism in gas exhaust side is shown in FIG. 9B. As it is understood from the FIG. 3, gas of lower temperature is charged from the valve in gas intake side and gas of higher temperature is exhausted from the valve in gas exhaust side. Thus, temperature of exhaust valve 10 is much higher than that of the valve 20 in gas intake side. The valve 10 in gas exhaust side is easy to expand. The displacement absorbed by the displacement absorbing mechanism against the valve in gas exhaust side is larger than that absorbed by the displacement absorbing mechanism against the valve in gas intake side.

Materially, the inclination degree $\alpha 1$ of tapered portion 4A' formed in the retaining member 2A of the rocker arm 2 in gas intake side is larger than that of the inclination degree $\alpha 2$ of tapered portion 4A formed in the retaining member 3A of the rocker arm 3 in gas exhaust side. By providing the inclination degrees $\alpha 1$ and $\alpha 2$ in the tapered portions 4A' and 4A, respectively, the locking balls 8, 8 in gas exhaust side are moved higher than the position of the locking balls 8', 8' in the gas intake side. Namely, when the displacement of the valve 20 in gas intake side is designated as $\Delta l$ 1 and another displacement of the valve 10 in gas exhaust side is designated as $\Delta l$ 2 and their difference is designated as $\Delta l$, the equation is $\Delta l = \Delta l\ 2 - \Delta l\ 1$. The valve 10 in the gas exhaust side can absorb larger displacement amounts indicated by $\Delta l$.

In this third embodiment the inclination degrees of the tapered portion 4A (4A') are adjusted. It is also possible to change diameters of the locking balls 8 (8') in place of adjusting the displacement amounts of the displacement absorbing mechanism. Namely, a smaller diameter of the locking balls in the same tapered portions can absorb larger displacement.

Figure 10:
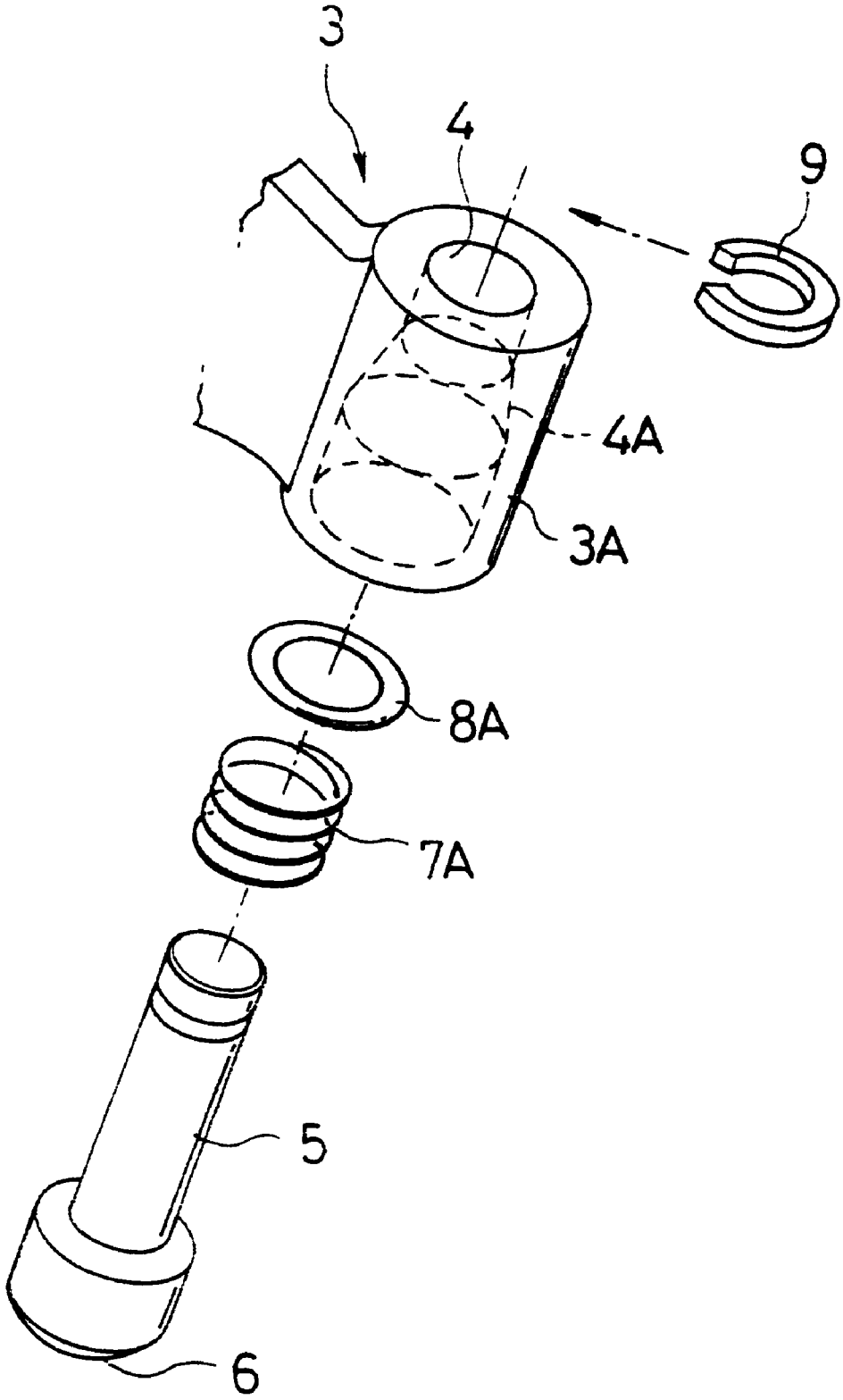
FIG. 10 is an analytical and perspective view which shows the fourth embodiment according to the present invention.
Figure 11B:
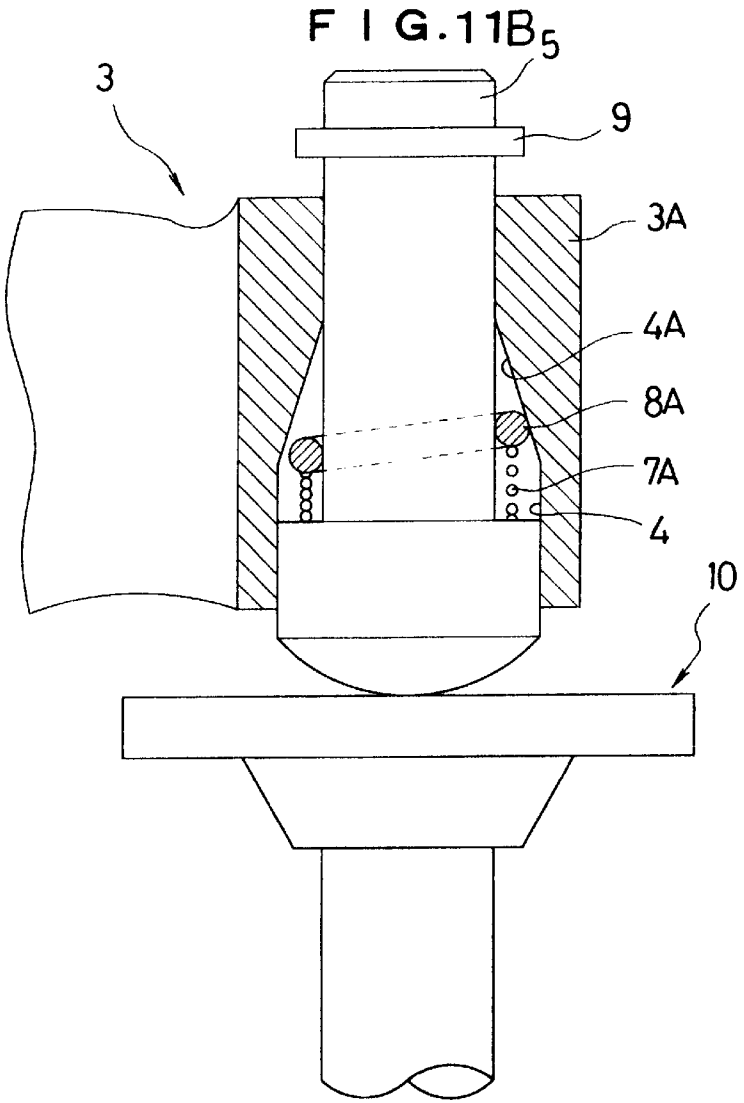
FIG. 11A and FIG. 11B show a working status of the fourth embodiment according to the present invention.
Figure 11A:
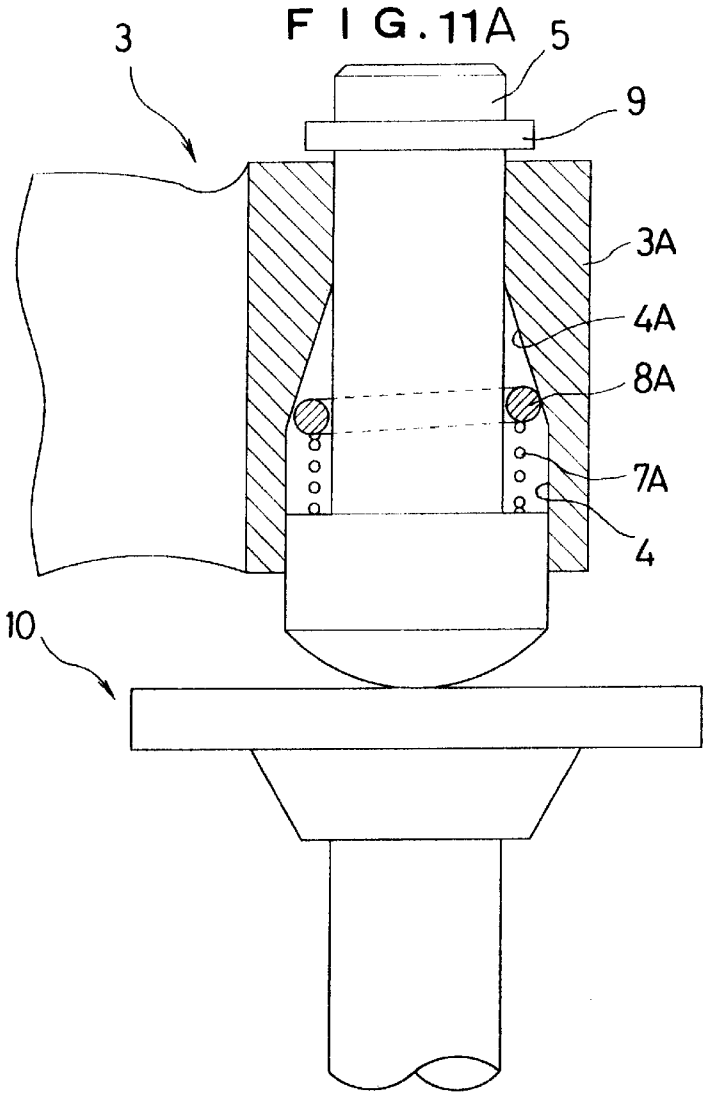

The fourth embodiment of the present invention is explained. It is also possible to apply a doughnut like ring member 8A as shown in FIG. 10 in place of the push rod control means. FIG. 10 shows an analytical and perspective view when a doughnut like ring member 8A is applied. The inside diameter of the ring member 8A is larger than that of the rod diameter of the push rod 5 as shown in FIG. 11A.

Operation to control the push rod 5 by means of the ring member 8A is explained as follows. When the rocker arm 3 is positioned in its utmost upper point, the ring member 8A, as shown in FIG. 11A, is hold as one end (right side in the figure) of said ring member 8A is retained higher than the other end (left side) by means of return spring 7A. The right side is forced and kept higher. After sometime, the rocker arm starts its motion downward, and the ring member 8A moves upward by means of the acceleration generated in the movement of the rocker arm 3.The ring member 8 comes to contact with the tapered portion 4A and the ring member 8A is somewhat moved toward left direction. As shown in FIG. 11B, a part of the ring member 8A is clamped between the tapered portion 4A and the push rod 5. The push rod 5 is controlled by the rocker arm 3 and the push rod 5 is moved downward integral with the rocker arm 3. The valve 10 is pressed down by means of the push rod 5 and it is released later.

When the rocker arm 3 is reached to the utmost lower point and then movement direction is changed upward the ring member 8A is moved downward. For this reason, the push rod 5 is released and it is free from the control of the rocker arm 3. The rocker arm 3 continues its movement upward and the upper surface of the retaining member 3A of the rocker arm 3 contacts the circlip 9 and the valve stem 11 is moved upward by the force of the valve spring 12 and the valve 10 comes into closed condition. Afterward, the rocker arm 3 and the push rod 3 return to the position shown in FIG. 11A. Actuation direction is adversely changed and the rocker arm 3 starts to go downward. By repeating this motion, the valve 10 is opened and closed consecutively.

Effect of the Invention

The present invention offers a new valve opening and closing mechanism which generates no clearance between the push rod and the valve, thus adjustment work of tappet clearances becomes unnecessary. Accordingly, undesirable condition due to adjustment of tappet clearance becomes unnecessary. Cooling liquid passages are not required. This system is applied to rather complex structure of the engine.

What is claimed is:

1. A valve opening and closing mechanism for engines consisting of rocker arms which rock in proportion to actuation of cams, the rocker arms are provided with through holes at each one end, respectively, and through which push rods are inserted, and when the push rods are moved forward with respect to said rocker arms, the valves are opened against the forces by valve springs, whereas when the push rods are moved backward the valves are closed by means of the force by the valve springs, said valve opening and closing mechanism comprising:

providing a circlip on the top portion of a push rod, a head of the push rod and an end of a stem of said valve are contacted, providing a displacement absorbing mechanism to absorb the displacement by means of heat expansion of said valve, the displacement absorbing mechanism being formed in the hole of the rocker arm at one end and has a tapered portion which reduces the size as it extends away from the valve, a push rod control means which is movable along the longitudinal direction of the push rod which are provided between the tapered portion and the push rod, the push rod control means actuates as a receiving part of the force of a return spring to absorb displacement due to the heat expansion of the valve, the valve spring pushes the head of the push rod toward the valve direction with a weaker force than the force by said valve spring, when the valves are opened, the push rods control means move backward with respect to the rocker arms and the push rod control means is placed between said rocker arms and push rods, the push rods are forwarded integral with said rocker arms in controlled condition, when the valves are closed, said push rods control means move forward with respect to the rocker arm and said push rods are in released condition and said rocker arm contacts said circlip and said push rods are moved backward.

2. The valve opening and closing mechanism for engines according to claim 1 wherein heat exhaust holes and heat exhaust rib cuts are formed in said push rods, said holes are filled with cooling liquid.

3. The valve opening and closing mechanism for engines according to claim 2 wherein the displacement absorbing mechanisms are provided in the valves in gas intake side and gas exhaust side, in which the amounts of displacement absorbed by the displacement absorbing mechanism against the gas exhaust valve is larger than the amounts of displacement absorbed by the displacement absorbing mechanism in gas intake side.

4. The valve opening and closing mechanism for engines according to claim 1 wherein the displacement absorbing mechanisms are provided in the valves in gas intake side and gas exhaust side, in which the amounts of displacement absorbed by the displacement absorbing mechanism against the gas exhaust valve is larger than the amounts of displacement absorbed by the displacement absorbing mechanism in gas intake side.

* * * * *